United States Patent [19]

Walsh

[11] Patent Number: 4,458,300

[45] Date of Patent: Jul. 3, 1984

[54] DISPOSABLE FLASHLIGHT

[76] Inventor: David J. Walsh, 2512 Mississauga Rd., Mississauga, Ontario, L5H 2L5, Canada

[21] Appl. No.: 378,543

[22] Filed: May 17, 1982

[51] Int. Cl.[3] ..... F21L 7/00

[52] U.S. Cl. ..... 362/206; 362/189; 362/205; 200/60

[58] Field of Search ..... 200/60; 362/205, 206, 362/204, 189

[56] References Cited

U.S. PATENT DOCUMENTS 1,839,971 1/1932 Korsen ..... 362/189

*Primary Examiner*—Stephen J. Lechert, Jr.

[57] ABSTRACT

The present invention provides a simple light which has a minimum of parts and which can be assembled simply and conveniently. The light is preferably a disposable penlight and includes a pocket clip assembly which is coupled electrically to an energy source and bulb and which has an arm movable by squeezing the arm to bring a distal end piece of the arm into contact with the housing to energize the bulb. The clip assembly includes a non-conductive fulcrum piece which is attached to the arm in engagement with the housing and intermediate the ends of the arm. This piece maintains the end piece of the clip remote from the housing to prevent accidental contact and to increase the force needed to bring the end piece into contact with the housing.

4 Claims, 3 Drawing Figures

DISPOSABLE FLASHLIGHT

This invention relates to simple lightweight flashlights of a type commonly referred to as penlights, and more particularly to disposable penlights.

Penlights are used as a convenient and portable means of providing an inspection light used by doctors, technicians, and persons interested in various hobbies. Such products are also sold as promotional items and can be incorporated into a simple tool kit for emergency use.

The penlights generally resemble a pocket pen and have a clip for attachment to the user's pocket. Although not essential, it is common to manufacture the lights to have a life equal to that expected of the energy source contained in the light. Such disposable structures must therefore be simple to manufacture in order to keep the cost to a minimum. The present description will be directed mainly to a disposable penlight which is exemplary of other structures within the scope of the invention.

The requirements for a simple disposable penlight are readily identified. A casing or housing contains an energy source which is usually two conventional cells or batteries in series and which have an electrical connection through a bulb with an end terminal of one of the batteries. There is a connection with the other battery case and a switch is provided which is coupled in some way to the battery case and is capable of closing the circuit between the case and the housing so that the bulb will light. Commonly the switch is in the penlight clip which is normally displaced from the housing and can be brought into contact by squeezing the clip against the housing. It will also be appreciated that the housing must be isolated electrically from the clip or be non-conductive if the penlight is to be secure from activation by contact with extraneous conductive structures.

An example of a prior art structure is shown in U.S. Pat. No. 3,902,058 to Naylor et al. In this patent a non-conductive housing is provided and the necessary electrical connections are made internally. A somewhat complex clip includes a resilient portion which has one end passing through the casing to be in permanent electrical contact and the other end is made to complete the circuit internally when the clip is squeezed toward the casing. This structure has found some commercial acceptance but suffers from disadvantages which are typical of many prior art structures. For instance one disadvantage lies in the assembly procedure. The clip must be somehow engaged through an opening in the casing and after the internal parts are positioned in the casing, the end of the casing must be rolled or otherwise deformed to permanently contain those parts. Such operations are both time consuming and costly.

A second disadvantage is that the structure uses a lot of small parts which are awkward to handle and which must be retained in the proper relationships until the casing is deformed inwardly.

By contrast, the present invention is intended to overcome these disadvantages by providing a simple light which has a minimum of parts and which can be assembled simply and conveniently. Accordingly, in one of its aspects the light includes a pocket clip assembly which is coupled electrically to an energy source and bulb and which has an arm which is movable by squeezing the arm to bring a distal end piece of the arm into contact with the housing to energize the bulb. The clip assembly includes a non-conductive fulcrum piece which is attached to the arm in engagement with the housing and intermediate the ends of the arm. This piece maintains the end piece of the clip remote from the housing to prevent accidental contact and to increase the force needed to bring the end piece into contact with the housing.

This and other aspects of the invention will be better understood with reference to the drawings, in which.

Figure 1:
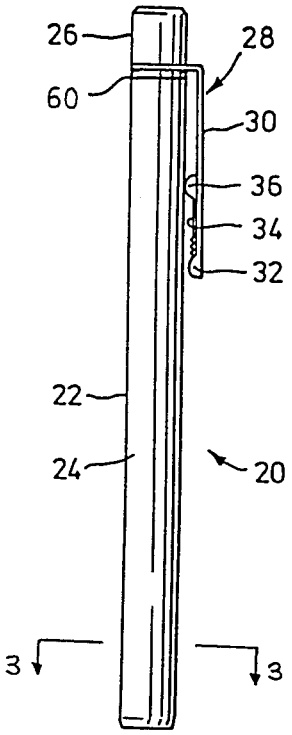
FIG. 1 is a side view of a preferred embodiment of a penlight made according to the invention and showing a clip assembly.

Reference is first made to FIG. 1 which illustrates a penlight indicated generally by the numeral 20. The penlight includes a housing 22 made up of a casing 24 and an end cap 26. These parts combine to contain the necessary elements which will be described with reference to FIG. 2 as well as a clip assembly 28 having an arm 30 and end piece 32. The clip assembly is electrically conductive but for an insulating fulcrum piece 34 coupled to the arm as will be described. As seen in FIG. 1 the fulcrum piece includes an enlarged end part 36 in contact with the casing sufficient to maintain the end piece 32 of the arm 30 away from the casing 24. Consequently in the position shown in FIG. 1, there is no electrical contact between the end piece 32 and the casing so that the light is not on. This will be better understood following the description of FIG. 2 which will be described with reference to the assembly procedure used to make the penlight.

Figure 2:
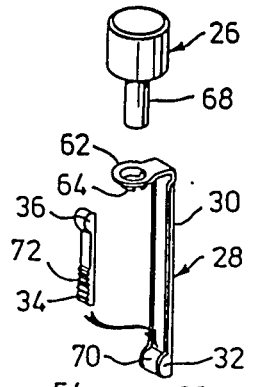
FIG. 2 is an exploded perspective view of the parts used to make the penlight.
Figure 3:
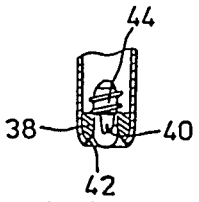
FIG. 3 is a sectional view on line 3—3 of FIG. 1 and showing the end structure of the penlight.

As seen in FIG. 2, the main element is the casing 24 which is made from tubular aluminum having an anodized outer surface, one end of which is formed to retain an end insert 38 as shown in FIG. 3. This insert defines a central opening 40 and an end recess 42 forming a reflector for a bulb 44. The casing is further worked to provide a small area 46 where the insulating anodized layer is penetrated for electrical contact by the end piece 32 of the clip assembly 28 as will be described.

After the casing has been completed by entering the end insert 38 and preparing the surface at 46, the casing can be stood in any suitable fixture which will provide support while the parts are added. First the bulb 44 is dropped into the casing to naturally take the position shown in FIG. 3. Next, two long life batteries 48, 50 are dropped into the casing with the projecting pole downwards so that the first pole will come into engagement with the end contact of the bulb 44. These batteries are provided with a synthetic plastic coating to insulate the cylindrical sides of the batteries from the casing 24. The upper ends (as shown) of the batteries are of course free of insulation to provide electrical contact.

After the batteries have been dropped into the casing 24, an insulator 52 is engaged in the upper end of the casing. This insulator has a central opening 54 for receiving a simple compressive coil spring 56, and is a firm engagement fit inside the casing. Diametrically opposed slits 58 (one of which can be seen) are provided to ensure that the insulator can be inserted in the tube readily and an end collar 60 is provided to locate the insulator on the end of the casing. After this insulator has been pushed into the casing, the spring 56 is dropped through the insulator and the clip assembly is added. As previously described, this clip assembly includes an arm 30 having at one end an end piece 32. At its other end, the arm is attached to a support 62 which defines an opening within a short tubular extension 64 adapted to fit within an enlarged recess 66 at the upper end of the opening 54 in the insulator 52. It will be appreciated that the tubular extension 64 effectively locates the clip assembly relative to the insulator to maintain the clip assembly in position while the end cap 26 is added, and improves electrical contact between the clip assembly and the end cap. The end cap includes a cylindrical projection 68 shaped to be an interference fit in the opening 54 within the insulator 52. Consequently when the end cap is brought into the opening 54, it is necessary to provide a downward force to engage the end cap. This is provided by a suitable press without removing the assembly from the fixture, which is of course shaped to accept the downward force at the bottom end of the flashlight without damaging the end structure of the flashlight.

Returning to the clip assembly, prior to the overall assembly, a sub-assembly is conducted as previously mentioned. The fulcrum piece 34 is shaped to fit within the end piece 32. To facilitate this, the arm and end piece 32 of the clip assembly are formed from a relatively thin metal sheet having a rolled portion 70 providing a space indicated by the arrow to receive a serrated tongue 72 of the fulcrum piece 34. These serrations permit location behind the rolled piece 70 in any one of the corrugations. Consequently the location of the end part 36 of the fulcrum piece 34 can be varied relative to the length of the arm thereby providing a means of adjustment for the force needed to squeeze the end piece 32 against the part 46 of the casing.

The electrical connections will next be explained with reference to the preferred materials used in the penlight shown in the drawings. As mentioned, the casing 24 is of aluminum with the outer surface anodized. There is an electrical connection from the batteries to this casing via the bulb 44 and end insert 38. At the other end of the batteries, the spring 56 is separated from the casing by the insulator 52 which is preferably of NYLON (registered trade mark). Electrical contact is made with the spring by the projection 68 of the end cap 26 which is also of aluminum. This end cap is in contact with the clip assembly so that the circuit from the pole formed by the casing of the battery 50 passes via the spring to the end cap and hence to the arm 30 and end piece 32. These parts are insulated from the casing by the fulcrum piece 34. It will be appreciated that because the casing is anodized, the fulcrum piece could conceivably be of a conductive material. However it is preferable to use a non-conductive material such as NYLON for this piece in order to ensure that the insulation will not fail as a result of wear in the anodized layer.

The electrical circuit is completed by pressing the end piece 32 of the arm 30 into engagement with the area 46 of the casing 24. As mentioned, the force necessary to perform this operation can be varied by the location of the end part 36 of the fulcrum piece 34.

The batteries are preferably alkaline cells which have a two year shelf life and do not require refrigeration. This is a distinct advantage over prior art devices which have used cells which require refrigeration to maintain a charge.

Variations to the structure are possible without departing from the inventive concept. It would obviously be possible to introduce an end cap which can be removed for replacing the batteries. This could be done by threading the cap or by other means. However the thrust of the present invention is to provide a disposable structure having parts which are inexpensive and which is capable of simple assembly to minimize cost. Although other forms of insulation of the casing could be used such as synthetic plastic coating, it should be appreciated that this coating is necessary only to prevent extraneous connection between the casing and the arm 30. If such connection is not a problem, then the insulation would not be necessary on the casing. These and other changes to the structure are within the scope of the invention as described and claimed.

I claim:

1. A lightweight flashlight structure comprising:

an electrically conductive tubular casing open at both ends and having an insulating coating;

a bulb;

means at one end of the casing locating and retaining the bulb with the glass portion of the bulb exposed, this means electrically connecting the bulb to the casing;

energy means having two poles and contained in the casing for activating the bulb, the energy means having one of the poles coupled electrically to the bulb so that the casing is coupled electrically to said one of the poles through the element of the bulb;

a tubular insulator firmly engaged in the other end of the casing;

an electrically conductive spring contained in the insulator and in engagement with the other of the battery poles;

an electrically conductive end cap having a portion in frictional engagement with the insulator and in electrical contact with the spring;

an electrically conductive clip assembly having a portion trapped between the insulator and the end cap, a arm projecting alongside the casing, the arm terminating at its distal end in an end piece, and an insulating fulcrum piece coupled to the arm and having a part in engagement with the casing so that the end piece is adjacent to but separated from the casing whereby upon squeezing the end piece into engagement with the casing the bulb lights.

2. In a penlight having an electrically conductive housing containing an energy source, a bulb for activation by the energy source, and a pocket clip assembly coupled electrically to the energy source and bulb, and having an arm movable by squeezing to bring a distal end piece of the arm into contact with the housing to energize the bulb, the improvement in which a non-conductive fulcrum piece is attached to the arm in engagement with the housing and intermediate the ends of the arm to maintain the end piece of the clip remote from the housing to prevent accidental contact and to increase the force needed to bring the end piece into contact with the housing.

3. A structure as claimed in claim 2 in which the fulcrum piece is adjustably coupled to the arm for positioning at different locations relative to the end piece to vary the force required to squeeze the end piece into contact with the housing.

4. A lightweight flashlight structure comprising:

an electrically conductive housing having an elongated casing and an end cap;

a bulb contained at one end of the casing and having the glass of the bulb visible from outside the housing and one of the two electrical connections of the bulb coupled electrically to the casing;

battery means contained inside the casing with one pole of the battery means in contact with the other of the bulb's electrical connections;

insulator means engaged between the casing and the end cap;

means coupling the other pole of the battery means to the end cap;

electrically conductive clip means coupled to the end cap externally of the housing and including means normally retaining the clip means out of engagement with the casing whereby the user can energise the bulb by squeezing the clip means into engagement with the casing.

* * * * *